US005499596A

United States Patent [19]

Brown et al.

[11] Patent Number: 5,499,596

[45] Date of Patent: Mar. 19, 1996

[54] MARINE VESSEL LAUNCH APPARATUS UTILIZING EXPLOSIVE TRIGGERS

[75] Inventors: Gayle C. Brown, Gretna; Juan J. Campo, Metairie; Philip F. Heiser, Schriever; Steven M. McKnight, Slidell, all of La.

[73] Assignee: McDermott International, Inc., New Orleans, La.

[21] Appl. No.: 409,290

[22] Filed: Mar. 23, 1995

[51] Int. Cl.[6] ..... B63B 23/00

[52] U.S. Cl. ..... 114/375; 405/1

[58] Field of Search ..... 114/65 R, 365, 114/367, 375; 405/1, 2, 3

[56] References Cited

U.S. PATENT DOCUMENTS

| | | | |
|---|---|---|---|
| 464,921 | 12/1891 | Carr | 405/1 |
| 1,840,804 | 1/1932 | Barnett | 114/375 |
| 2,337,101 | 12/1943 | Harris | 405/1 |
| 3,600,897 | 8/1971 | Van Der Werff | 405/1 |
| 4,365,579 | 12/1982 | Perez, Jr. | 114/365 |

*Primary Examiner*—Stephen Avila

*Attorney, Agent, or Firm*—Robert J. Edwards; D. Neil LaHaye

[57] ABSTRACT

A marine vessel launch apparatus utilizing cradle wedges that are released by explosive triggers. The cradle wedges are located above each skidway and directly support the vessel. The cradle wedge is shaped and sized to provide a direct means of connecting the cradle wedge to the vessel tieback/support. The tieback/support for the cradle wedge is rigidly attached to the skidway. The tieback/support and cradle wedge are held together with bolts and frangible nuts. Explosive charges are used on the frangible nuts to release the cradle wedges from the tieback/support and launch the vessel. Jacks provide positive horizontal pressure on the cradle wedges to break static friction between the cradle wedges and skidways to initiate vessel motion down the skidways and into the waterway.

3 Claims, 5 Drawing Sheets

MARINE VESSEL LAUNCH APPARATUS UTILIZING EXPLOSIVE TRIGGERS

BACKGROUND OF THE INVENTION

1. Field of the Invention

The invention is generally related to the building of large vessels and more particularly to the launching of such vessels.

2. General Background

Construction of large marine vessels typically takes place on skidways from which the vessel is launched into a waterway. The skidways are sloped in order to allow the vessel to slide, mostly through the effect of gravitational force. Construction directly on the skidways is due mostly to the significant weight of marine vessels and the necessity of getting the vessel in the water. The vessel is typically supported on cradles that rest directly on the skidways. The cradles are temporarily secured to the skidways or anchored to suitable supports on land by means of tiebacks to prevent the vessel from launching prematurely. Once the vessel is completed, it is launched by releasing the tieback restraining elements that connect the cradles to the supports. The vessel and cradles go into the water where the cradles separate from the vessel as the vessel gains buoyancy and reaches a stable floating position. The use of preassembled sections or modules is common in marine vessel construction. Vessel modules are constructed in buildings that provide protection from the weather and are transported to the launch site, where they are connected together. The usual launch procedure involves activating mechanical releases which are integral parts of the tieback system. To assist the launch, positive horizontal pressure is typically provided on the marine vessel or its cradles, usually by means of hydraulic jacks. The mechanical release/tieback system typically consists of a central spine or shaft with a release mechanism and is connected to a large counterweight. The individual cradle support release devices are also connected to the spine. Once the spine release is activated, the counterweight places the spine in motion. The spine movement activates the triggers in the cradle tiebacks nearly simultaneously. The release of the tiebacks and the horizontal pressure on the vessel or cradles by jacks or other means breaks the static friction between the cradles and the skidways, initiating the vessel's motion down the skidways and into the waterway. Conventional mechanical release systems have advantages and disadvantages. Mechanical release systems have proven reliable and adequate in the past but are expensive and time consuming to construct and require fabrication to close tolerances. The mechanical release systems must be maintained throughout the life of the launch facility. The mechanical release systems must be adjusted with every launch to suit the size of the marine vessel being constructed. There is no positive way to test-release the mechanism prior to the actual launch. It can be seen that there is a need for improvement over current mechanical release systems.

SUMMARY OF THE INVENTION

The invention addresses the above need. What is provided is a marine vessel launch apparatus utilizing cradle wedges that are released by explosive triggers. The cradle wedges are located above each skidway and directly support the vessel. The cradle wedge is shaped and sized to provide a direct means of connecting the cradle wedge to the vessel tieback/support. The tieback/support for the cradle wedge is rigidly attached to the skidway. The tieback/support and cradle wedge are held together during work on the vessel with bolts and frangible nuts. Explosive charges are used on the frangible nuts to release the cradle wedges from the tieback/support and launch the vessel. Jacks provide positive horizontal pressure on the cradle wedges to break static friction between the cradle wedges and skidways to initiate vessel motion down the skidways and into the waterway.

BRIEF DESCRIPTION OF THE DRAWINGS

For a further understanding of the nature and objects of the present invention reference should be had to the following description, taken in conjunction with the accompanying drawings in which like parts are given like reference numerals, and wherein.

DETAILED DESCRIPTION OF THE PREFERRED EMBODIMENT

Figure 1:
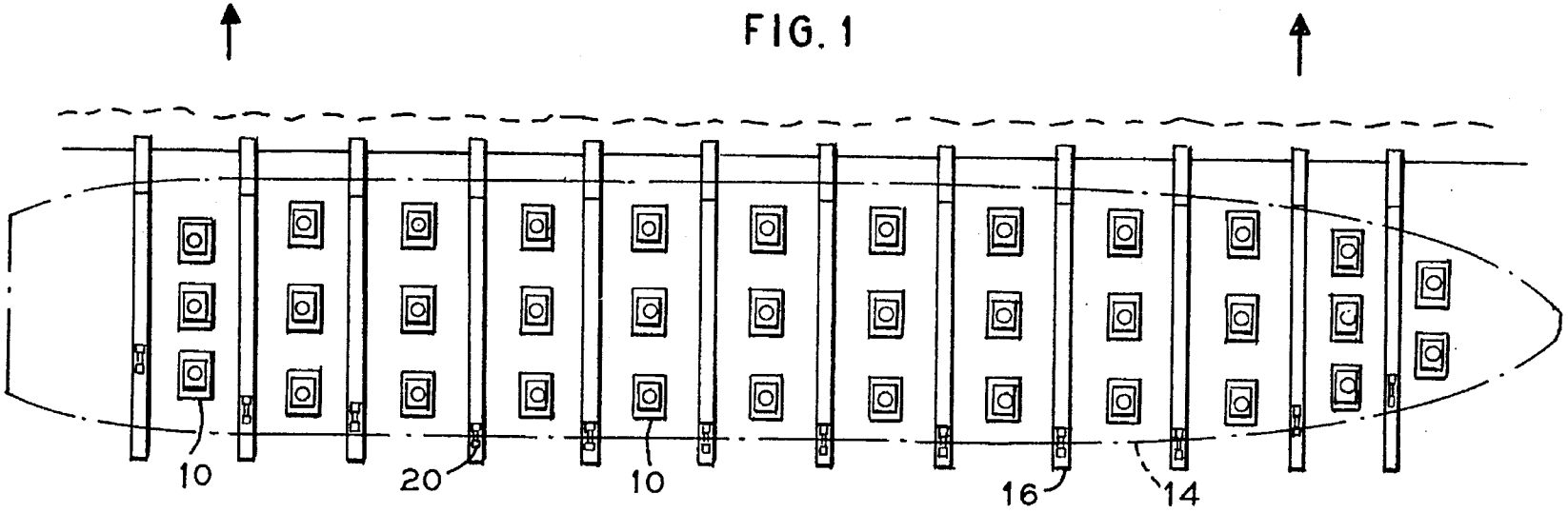
FIG. 1 is a plan view of a side launch facility.
Figure 2:
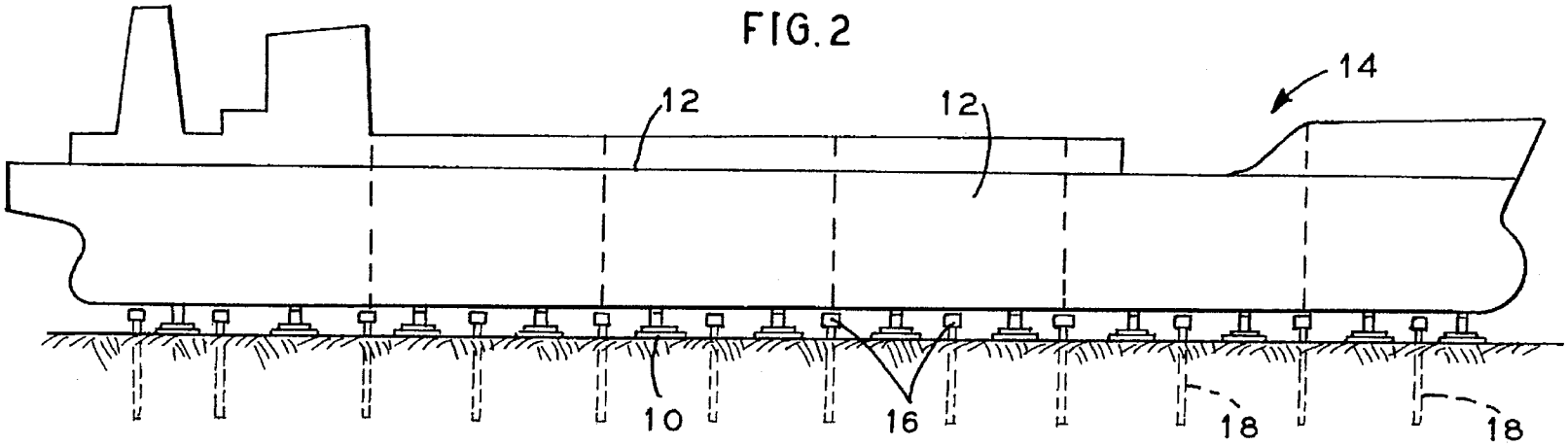
FIG. 2 is an elevation view of a side launch facility.

Referring to the drawings, FIG. 1 illustrates a layout of a typical side launch facility. Temporary supports 10 provide stable support for each module 12 (FIG. 2) of vessel 14. Each module 12 is supported above skidways 16 which are anchored in place by piles 18. Temporary supports 10 allow modules 12 to be joined together and surface finishing work done at the module junctions.

Figure 3:
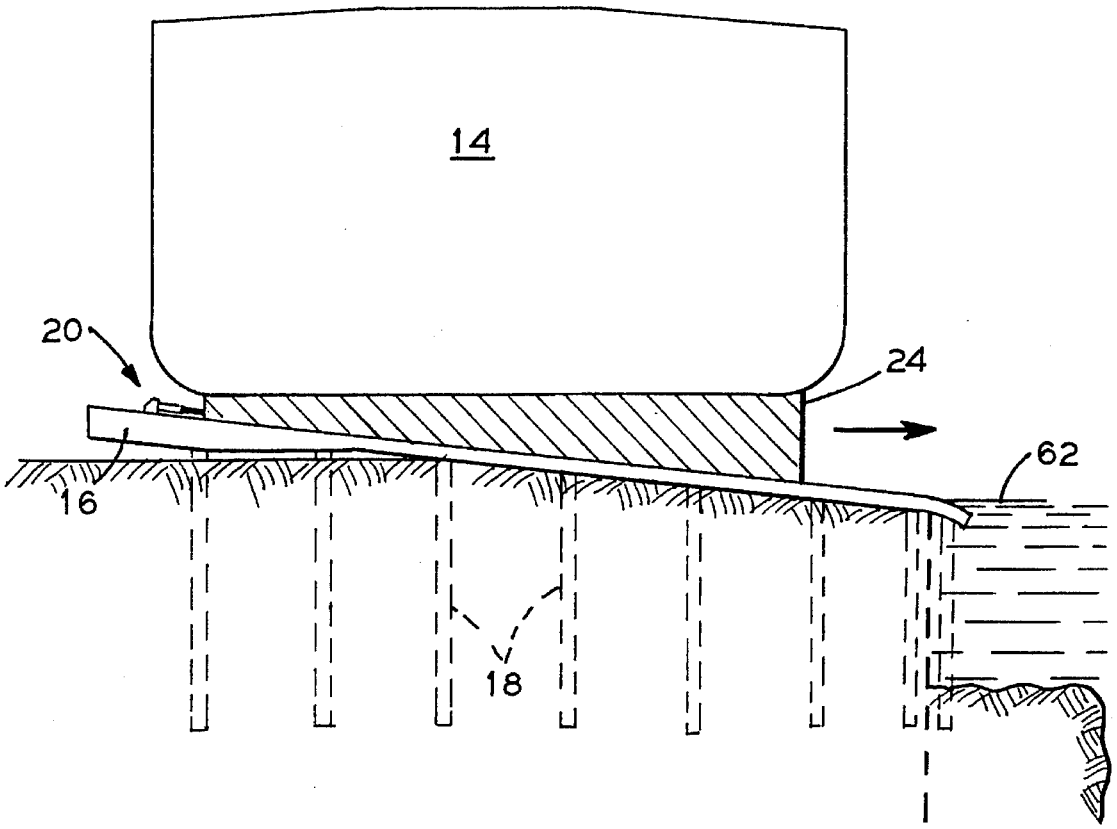
FIG. 3 is a transverse section view through the side launch facility of FIG. 1 and 2 showing the marine vessel on the launch cradle wedge.
Figure 4:
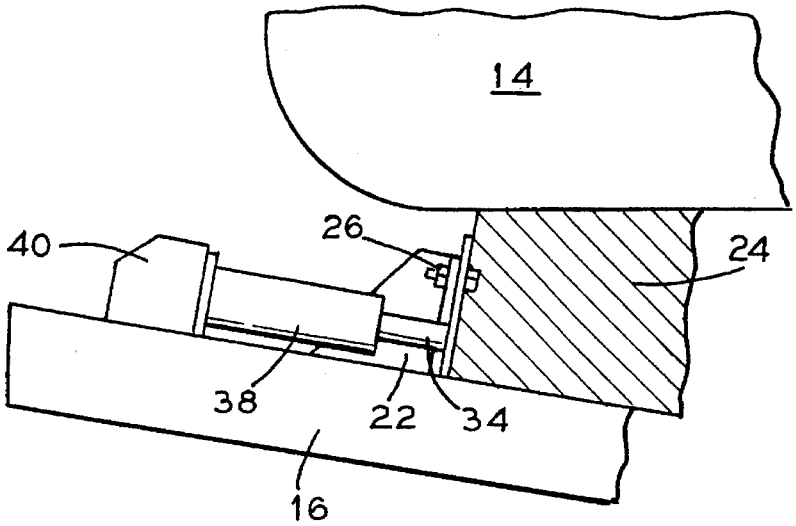
FIG. 4 is a detail view of the explosive trigger assembly of the invention.

The invention is generally indicated by the numeral 20 in FIG. 1 and 3. As seen in FIG. 4, vessel tieback/support and release apparatus 20 is generally comprised of support bracket 22, cradle wedge 24, and means 26 for detaching cradle wedge 24 from support bracket 22. It should be understood that one or more apparatus of the invention may be used in a launch facility. For ease of explanation, only one apparatus will be described.

Figure 7:
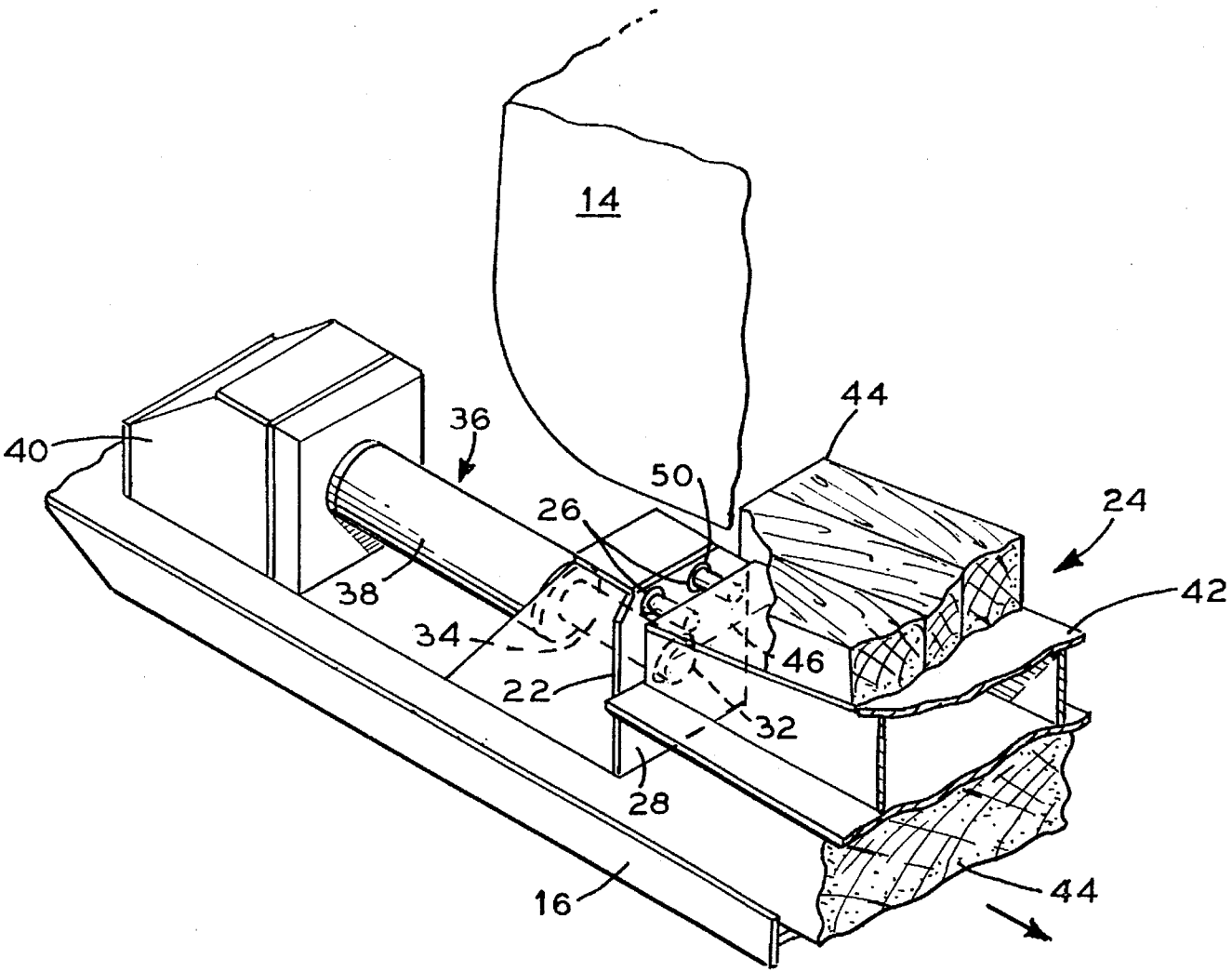
FIG. 7 is an elevation detail view of the invention before activation to allow launch of the vessel.
Figure 8:
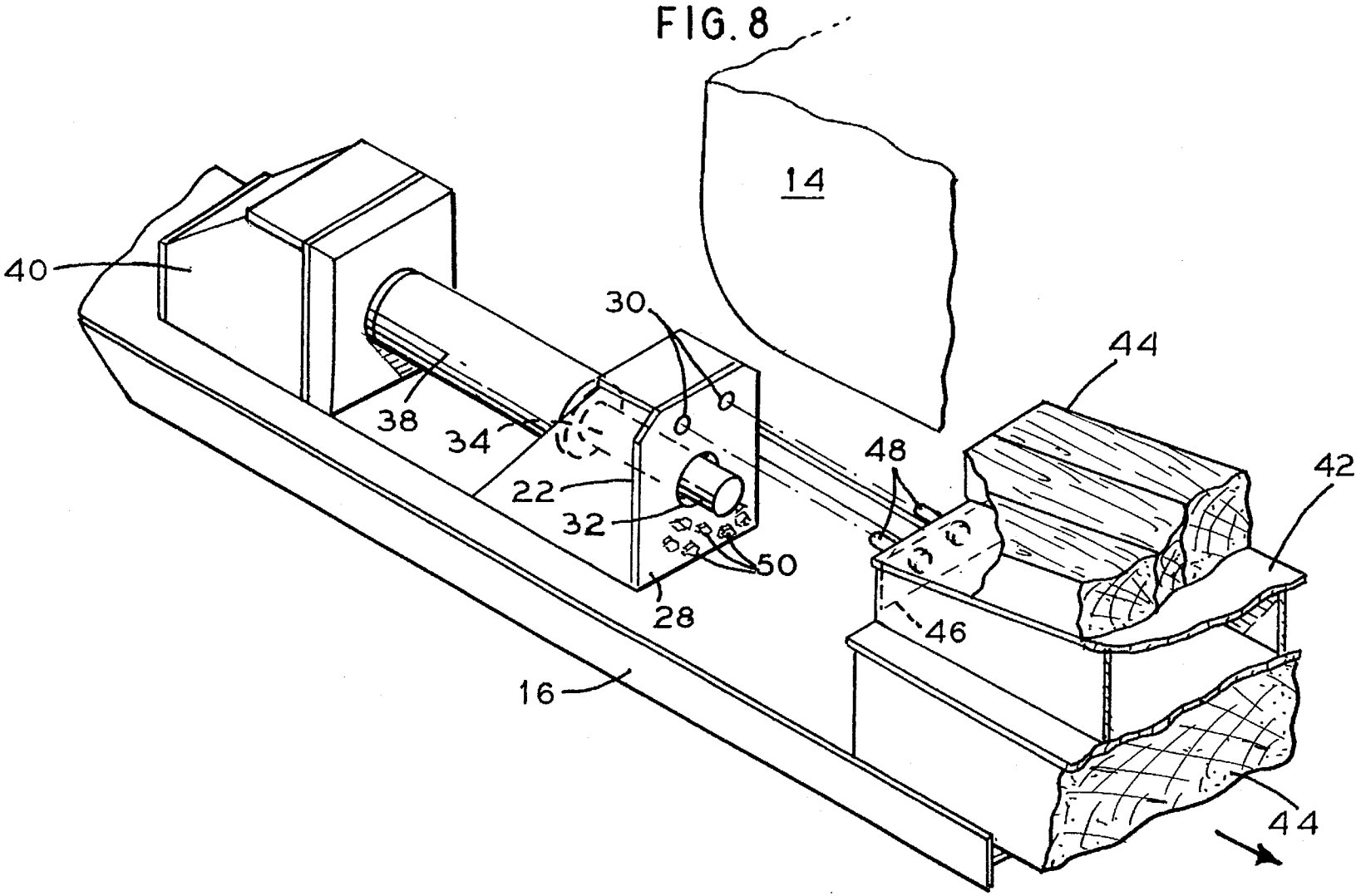
FIG. 8 is an elevation detail view of the invention after activation to allow launch of the vessel.

Referring to FIG. 7, support bracket 22 is rigidly attached to skidway 16 by any suitable means. Face plate 28 of support bracket 22 is sized and shaped to allow the end of cradle wedge 24 to abut against face plate 28. Face plate 28 is provided with bores 30 (best seen in FIG. 8) for receiving bolts from cradle wedge 24. Face plate 28 is also provided with bore 32 to allow passage of jack piston 34 therethrough as seen in FIGS. 7 and 8.

Hydraulic jack 36 is mounted on skidway 16 and has its hydraulic cylinder 38 held in position by jack stop 40 which is rigidly mounted on skidway 16.

Cradle wedge 24 is slidably received on skidway 16. Cradle wedge 24 may be made mostly of wood for small vessels but more typically is formed from a wedge-shaped steel beam 42 with timber runners 44 above and below beam 42. The cradle wedges's lower timber surface is in contact with skidway 16 and is greased to reduce friction during launch. The cradle wedge's upper timber surface is horizontal and in contact with vessel 14. Cradle wedge 24 is shaped and sized to allow attachment to support bracket 22. Cradle wedge 24 is provided with a face plate 46 that has bores therethrough that are coaxial with bores 30. This allows bolts 48 to be received through the bores and frangible nuts 50 to be threadably received on the bolts 48 to temporarily attach cradle wedge 24 to support bracket 22 and form the tieback/support arrangement.

Figure 5:
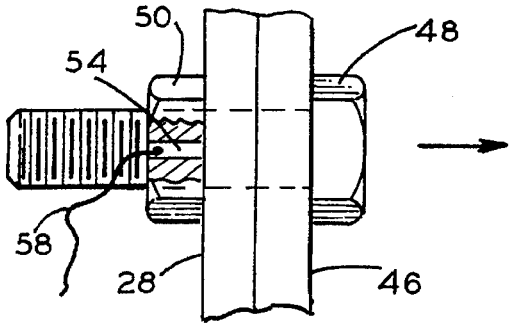
FIG. 5 is an elevation view of the frangible nut assembly of the invention.
Figure 6:
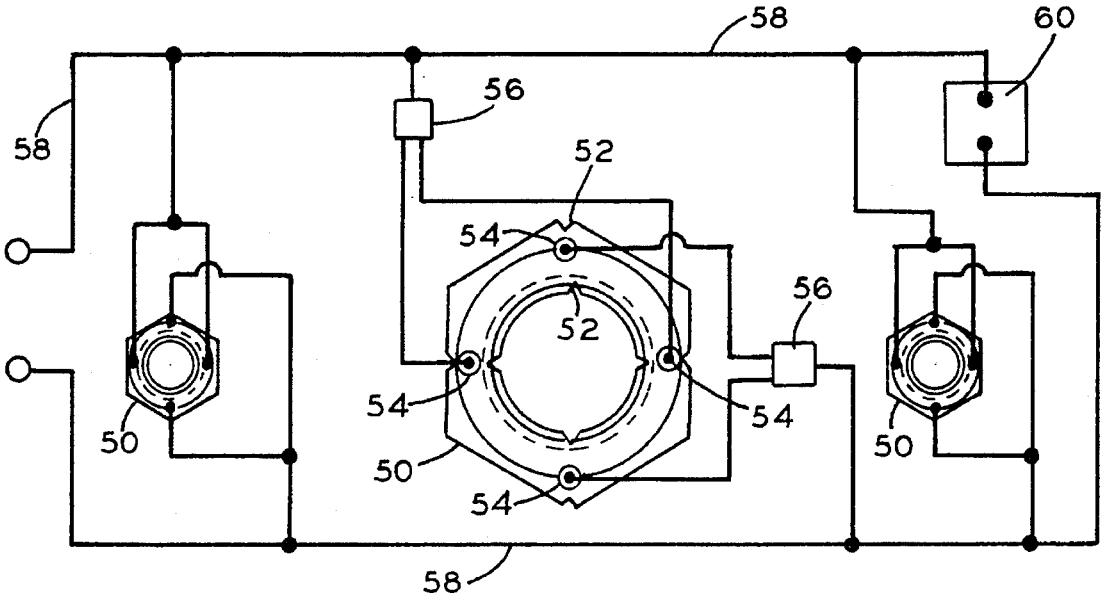
FIG. 6 is a schematic that illustrates the firing circuit with frangible nuts of the invention.

As seen in FIGS. 5 and 6, frangible nuts 50 are provided with four to eight shear slots 52 and two detonation systems which are connected to two separate electrical firing lines. Each detonation system is comprised of two explosive charges 54 and one electrical detonator 56 connected by electrical lines 58 to a firing unit 60. This provides one hundred percent redundancy to the system. Activation of the detonation system causes separation of frangible nuts 50 into four pieces.

In operation, vessel modules 12 are normally fabricated at a nearby covered facility and then transported to the launch facility when completed. Modules 12 are positioned on temporary supports 10, joined together, and finishing work is done. When ready to be launched, vessel 14 is lowered onto cradle wedges 24 on skidways 16. Bolts 48 and frangible nuts 50 hold cradle wedges 24, and consequently vessel 14, in place. In order to break the static friction, frangible nuts 50 can be loosened one or two turns a certain limited time before the launch. This can not be done in conventional mechanical release systems. The invention is readied for launch by connecting all of the explosive charges 54 to electrical firing lines 58 which are then connected together at firing unit 60. Hydraulic jacks 36 are activated prior to launch to impart a predetermined force on cradle wedges 24. Jack piston 34 provides positive pressure on the wedge cradle face plate 46. When explosive charges 54 are detonated, frangible nuts 50 are severed in four places as seen in FIG. 8. This allows bolts 48 to slide past support bracket 22. Since cradle wedges 24 are preloaded, the force of hydraulic jacks 36 and the horizontal component of the gravitational force acting on vessel 14 break any remaining static friction and cradle wedges 24 move down the sloped skidways 16 with vessel 14 into the water 62 as indicated by the arrows and in FIG. 3. As vessel 14 gains buoyancy, cradle wedges 24 separate from the vessel and sink. Cradle wedges 24 are retrieved for future use after the vessel is floated away.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. In a marine vessel launch facility having skidways for supporting and launching a vessel into a body of water, a vessel tieback/support and release apparatus, comprising:

a. a support bracket rigidly attached to the skidway, said bracket having a bore therethrough;

b. a cradle wedge having a bore therethrough coaxial with the bore in said support bracket, said cradle wedge being slidably received on the skidway;

c. a bolt received through the bores in said support bracket and cradle wedge;

d. a frangible nut threadably received on said bolt for temporarily holding said cradle wedge adjacent said support bracket;

e. means for causing shearing of said frangible nut to detach said cradle wedge from said support bracket; and f. a jack mounted on the skidway for imparting positive pressure on said cradle wedge.

2. The apparatus of claim 1, wherein said means for causing shearing of said frangible nut comprises an explosive charge in said nut.

3. In a marine vessel launch facility having skidways for supporting and launching a vessel into a body of water, a vessel tieback/support and release apparatus, comprising:

a. a support bracket rigidly attached to the skidway, said bracket having a bore therethrough;

b. a cradle wedge having a bore therethrough coaxial with the bore in said support bracket, said cradle wedge being slidably received on the skidway;

c. a bolt received through the bores in said support bracket and cradle wedge;

d. a frangible nut threadably received on said bolt for temporarily holding said cradle wedge adjacent said support bracket;

e. an explosive charge positioned in said frangible nut for causing shearing of said frangible nut to detach said cradle wedge from said support bracket; and f. a jack mounted on the skidway for imparting positive pressure on said cradle wedge.

* * * * *